US006468185B1

(12) United States Patent
Goldberg

(10) Patent No.: US 6,468,185 B1
(45) **Date of Patent: *Oct. 22, 2002**

(54) STATIONARY EXERCISE BICYCLE

(75) Inventor: Johnny Goldberg, Los Angeles, CA (US)

(73) Assignee: Mad Dog Athletics, Inc., Venice, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/672,197

(22) Filed: Sep. 28, 2000

Related U.S. Application Data

(63) Continuation of application No. 09/019,352, filed on Feb. 2, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.[7] ..... A63B 21/00
(52) U.S. Cl. ..... 482/57; D21/663
(58) Field of Search ..... 482/148, 51, 57–65; D21/663, 666, 667; 74/551.1, 551.8

(56) References Cited

U.S. PATENT DOCUMENTS

| | | | | |
|---|---|---|---|---|
| 562,198 | A | 6/1896 | Robinson | 482/52 |
| 588,166 | A | 8/1897 | McCoy | 74/551.1 |
| 633,534 | A | 9/1899 | Read | 280/261 |
| 635,082 | A | 10/1899 | Stiles | 280/261 |
| 671,785 | A | 4/1901 | Young et al. | 482/57 |
| 1,336,774 | A | 4/1920 | Cooper | 482/57 |
| 1,507,554 | A | 9/1924 | Cooper | 482/57 |
| 1,636,327 | A | 7/1927 | Roe | 424/144 |
| 3,062,204 | A | 11/1962 | Stefano | 128/25 |
| 3,511,097 | A | 5/1970 | Corwin | 73/379 |
| D251,747 | S | 5/1979 | Valentine et al. | |
| 4,188,030 | A | 2/1980 | Hooper | |
| D280,117 | S | 8/1985 | Collins | |
| D280,118 | S | 8/1985 | Collins | |
| 4,577,860 | A | 3/1986 | Matias | 272/73 |
| D284,596 | S | 7/1986 | McNeil | |
| 4,632,386 | A | 12/1986 | Beech | 272/73 |
| D289,782 | S | 5/1987 | Szymski et al. | |
| D291,462 | S | 8/1987 | Aalto | D21/194 |
| D292,304 | S | 10/1987 | Ostrom | |
| 4,768,777 | A | 9/1988 | Yang | 272/73 |
| 4,772,069 | A | 9/1988 | Szymski | 297/195 |
| 4,824,102 | A | 4/1989 | Lo | 272/73 |
| 4,880,225 | A | 11/1989 | Lucas et al. | 272/73 |
| 4,902,001 | A | 2/1990 | Balbo | |
| 4,915,374 | A | 4/1990 | Watkins | 272/73 |
| 4,936,570 | A | 6/1990 | Szymski et al. | 272/73 |
| 5,000,469 | A | 3/1991 | Smith | 280/261 |
| 5,145,477 | A | 9/1992 | Han | 482/57 |
| 5,232,422 | A | 8/1993 | Bishop, Jr. | 482/57 |
| 5,336,147 | A | 8/1994 | Sweeney, III | 482/57 |
| 5,423,728 | A | 6/1995 | Goldberg | 482/57 |

*Primary Examiner*—Stephen R. Crow
(74) *Attorney, Agent, or Firm*—Lyon & Lyon LLP

(57) ABSTRACT

A stationary exercise bicycle comprises a frame having front and rear ground support elements, a front socket and a rear socket, and a seat socket; a pedal mechanism on said frame and a seat mounted on a seat socket at a level above the pedal mechanism, the seat being mounted for movement fore and aft relative to the seat socket, and upwardly and downwardly relative to the pedal mechanism.

19 Claims, 5 Drawing Sheets

STATIONARY EXERCISE BICYCLE

CROSS REFERENCE TO RELATED APPLICATIONS

This is a continuation application of application Ser. No. 09/019,352, filed on Feb. 2, 1998, now U.S. Pat. No. 6,155,958 to Johnny Goldberg, which is a continuation of Ser. No. 08/736,976, filed on Oct. 25, 1996, now U.S. Pat. No. 5,722,916 to Johnny Goldberg, which is a continuation of application Ser. No. 08/391,438, filed on Feb. 21, 1995, now abandoned, which is a continuation of Ser. No. 07/969, 765, filed on Oct. 30, 1992, now U.S. Pat. No. 5,423,728 to Johnny Goldberg.

BACKGROUND

Having a stationary exercise bicycle capable of simulating mountain bike riding is valuable.

This invention relates to a stationary exercise bicycle which is sturdy and comfortable for use during extended periods of pedaling while standing or sitting or a combination thereof and thus capable of meeting the needs of the more demanding rider.

In recent years, the popularity of the stationary exercise bicycle has increased dramatically together with the fitness craze. Stationary exercise bicycles are conventionally made with straight, brazed round tubing. A problem associated with using the round tubing in these bicycles is their propensity for fragility. They easily snap under increased stress, for example, during periods when the rider is pedaling in a standing position or in an alternating standing and sitting pedaling position. Also, the bicycle structure does not provide for the best flexibility according to the preferences of the rider.

There is a need to provide a stationary exercise bicycle which is more durable and overcomes the problems of the prior art.

SUMMARY

The invented stationary exercise bicycle seeks to avoid the disadvantages associated with conventional stationary exercise bicycles.

According to the invention, the stationary exercise bicycle comprises a stable frame. Additionally, the frame comprises a front socket and a rear socket, and front and rear ground support elements. Also provided is a pedal mechanism on said frame.

Also, the bicycle comprises a detachable seat socket. A seat is mounted on a seat socket at a level above the pedal mechanism. The seat is mounted for movement fore and aft relative to the seat socket and upwardly and downwardly relative to the pedal mechanism.

Additionally, the stationary exercise bicycle comprises a handlebar mounted in the front socket. The handlebar includes at least two different handle means. One handle means includes spaced apart and outwardly directed elements. The second handle means includes an element inwardly located relative to the first handle means. The handlebar is adjustable in the front socket.

Further, in one preferred form, the frame comprises at least multiple upstanding posts. The posts are inter-engaging to form at least one triangulated structure between the ground support elements and one of the sockets.

Additionally, at least part of the front socket, rear socket, or seat socket are formed with a hollow member having a cross-section which is non-cylindrical.

The pedal mechanism may include a cog operative with an endless chain having slots for engagement with the cog. A ring guard is provided and protective of at least the interaction of the teeth of the cog with the endless chain. The ring guard is located internally of the perimeter defined by the endless chain.

The invented stationary exercise bicycle is strong and comfortable for the rider. The adjustability of the bicycle facilitates comfortable riding of the bicycle in multiple positions, for example, sitting, standing and different gripping positions. Moreover, it is stress-resistant so that it can be used by the rider in a standing position or in an alternating standing and sitting pedaling position for extended periods. Riders of this bicycle can simulate the aerobic effect of mountain bike racing.

According to another aspect of the invention, a stationary exercise bicycle is provided wherein the height and the fore and aft position of the seat is adjustable. The height of the handlebar is also adjustable. This adjustability allows the stationary exercise bicycle to be ridden in multiple positions to simulate different bicycle riding conditions.

Additionally, the invented stationary exercise bicycle is mobile and the parts, easily replaceable. Unlike conventional stationary exercise bicycles, the present invention utilizes regular bicycle components. The user can replace certain parts from conventional bicycle shops and thus service the present invention with conventional bicycle componentry. Further, unlike prior art stationary exercise bicycles, the present invention has four basic parts which are detachable and can be placed in a portable transport carrier for mobility.

The invention is now further described with reference to the accompanying drawings.

DRAWINGS

Figure 6A:
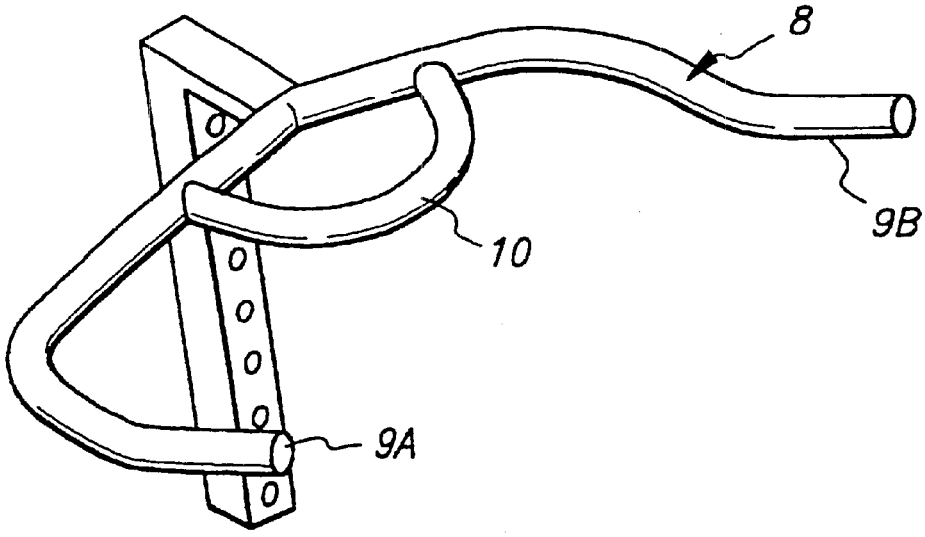
Figure 6B:
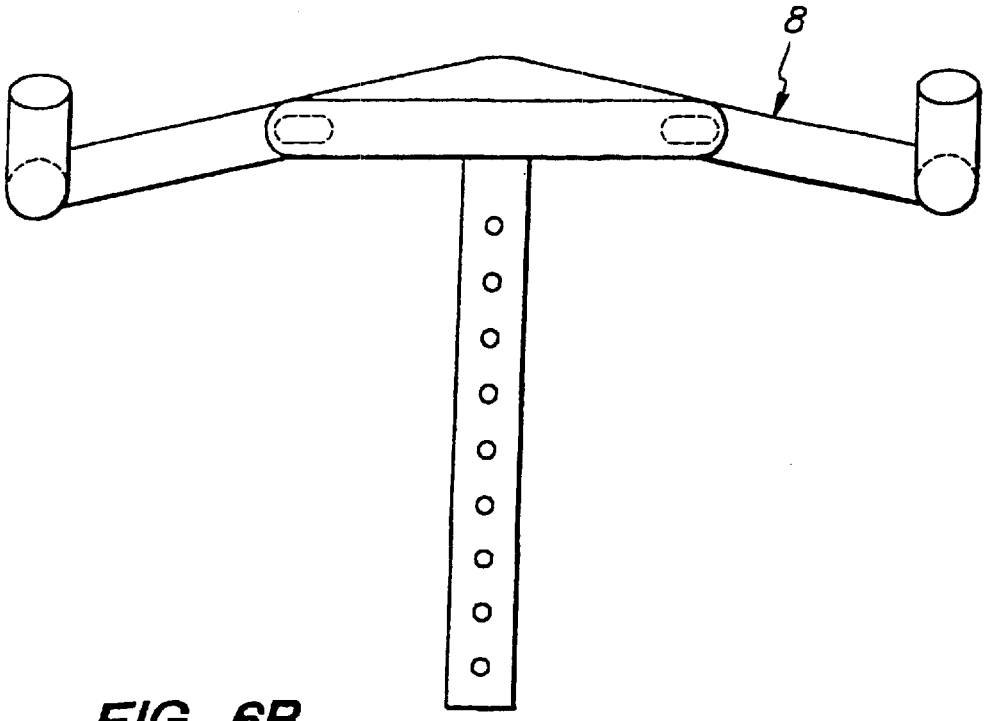
Figure 6C:
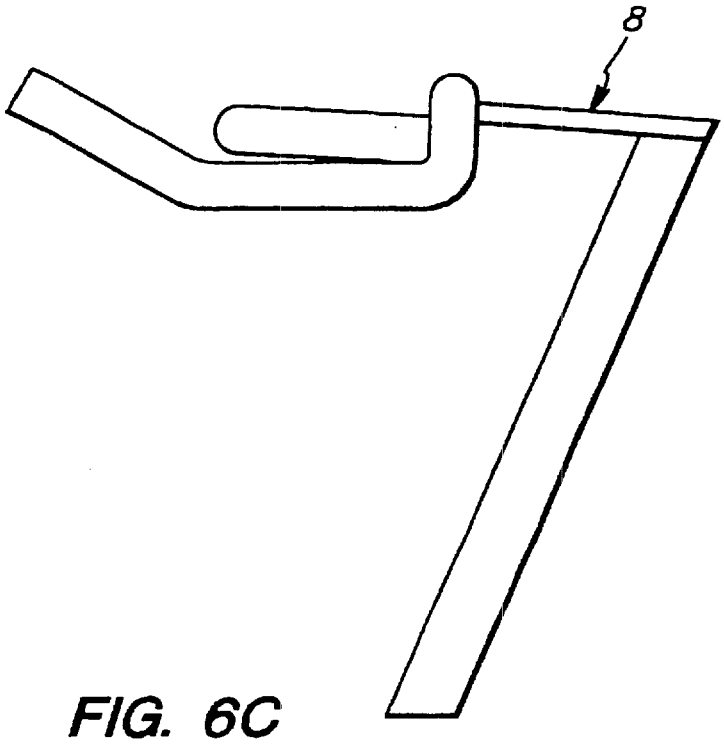
Figure 7:
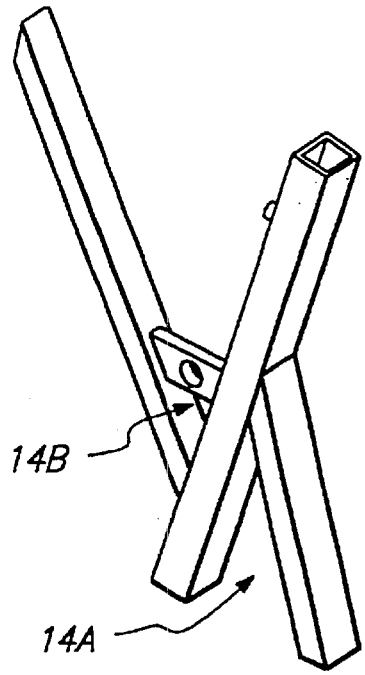
Figure 8:
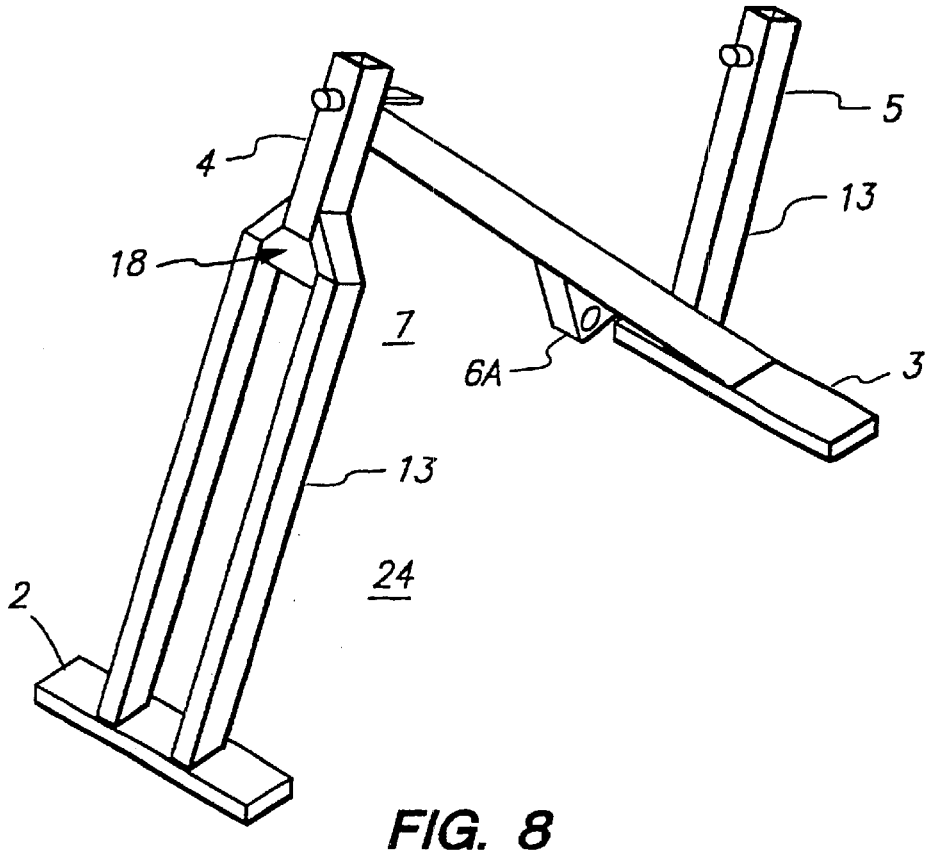

FIGS. 6A, 6B, and 6C are isometric, front and side views, respectively, of the adjustable and detachable handlebar including the forwardly extending prongs, the lateral bar, and the element inwardly located relative to the forwardly extending prongs;

FIG. 7 is an isometric view of the triangulated structure portion of the frame; and FIG. 8 is an Isometric view of an alternative frame.

DESCRIPTION

Figure 1:
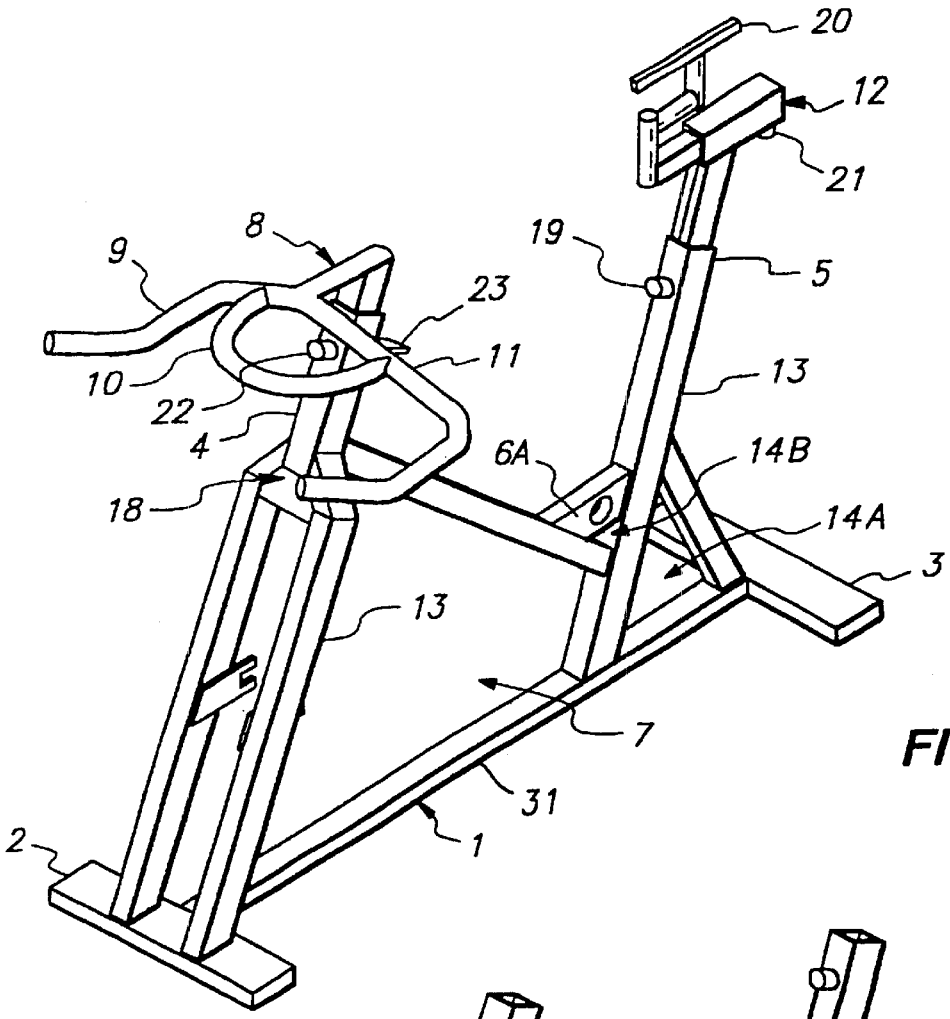
FIG. 1 is an isometric view of a frame for a stationary exercise bicycle.

A stationary exercise bicycle comprises a frame 1 (FIG. 1) or 24 (FIG. 8). The frame has a central ground support element 31, front 2 and rear 3 ground support elements, a front socket 4 and a rear socket 5 and a pedal mechanism 6. As discussed below and as shown in FIG. 1, pedal mechanism 6 generally includes a crankarm and crankset. The rear socket 5 is capable of receiving a seat socket 12. Further, a seat 20 may be mounted on the seat socket 12 at a level above the pedal mechanism 6. The seat 20 is mounted for movement fore and aft relative to the seat socket 12 and upwardly and downwardly relative to the pedal mechanism 6.

This stationary exercise bicycle further comprises a handlebar 8 mounted in the front socket 4. The handlebar 8 includes at least two different handle means 9 and 10. One handle means includes spaced apart and outwardly directed elements 9. The second handle means includes an element inwardly located 10 relative to the first handle means.

The outwardly directed handle means 9 have forwardly extending prongs 9A and 9B (FIG. 6A) which are directed axially away from the seat socket 12. The axially directed prongs 9A and 9B are connected with a lateral bar 11 of the handlebar 8 at one end and are free at an opposite end.

The inner handle means 10 is at least part of a closed ring. The ring is located between the outer handle prongs. Further, the ring is connected to a lateral bar 11 of the handlebar 8.

The closed ring may be a semi-circle. The axis for the semi-circle is located substantially about midway through the lateral bar 11 of the handlebar 8.

The handlebars have been designed with the user's handlebar position needs in mind. Because of the need for the different hand positions during the ride, the ring allows for different hand positions, movements, quick transition from sitting to standing, and standing back to sitting. It also allows, without the use of an attached arm pad, the ability to lie the forearm on the ring portion of the handlebar and simulate a real training cycling position.

The handlebar 8 may be connected to the frame 1 by the front socket 4. A handlebar pop pin 22 permits adjustment of the handlebar 8 according to the requirements of the rider. FIGS. 6A and 6B show the holes which permit the connecting member to be arrest-able by a pop pin for adjustment.

Applicant contemplates that alternative handlebars may be connected to the frame 1 or 24 in accordance with the rider's needs.

The frame 1 (FIG. 1) or 24 (FIG. 8) further comprises at least multiple upstanding posts 13. In a preferred form, the posts inter-engage to form at least one triangulated structure 14 between the ground support elements 2 or 3 and one of the sockets.

The frame 1 includes at least two triangulated structures 7 and 14 between the sockets 4, 5, and 12. The two triangulated structures 7 and 14 have at least one common upstanding post 13 forming at least one wall of the triangulated structures 7 and 14. One of the triangulated structures 7 and 14 includes an arm or cross-element 6A intended to mount the pedal mechanism 6.

The upstanding posts 13 form part of the triangulated structure 7 and 14. Moreover, the upstanding posts 13 are all located at a non-horizontal, non-vertical axis.

The triangulated structures 7 and 14 include the rear triangle 14A which includes an inverted V-shaped section and which functions to stabilize the frame 1; the bottom bracket triangle 14B which includes an upstanding V-shaped section and which functions to stabilize the frame 1 so a rider can pedal standing; the front triangle-like structure 7 which includes an inverted V-shaped section and which functions to permit total range of motion; and a front fork triangle 18.

The rear triangle 14A is important as a stabilizing block. Unlike conventional stationary exercise bicycles, the small base of this triangle gives the bike its total rigidity in the rear.

The bottom bracket triangle 14B gives the central part of the stationary exercise bicycle its rigidity and form for standing. Further, arm or cross-element 6A allows for conventional pedal mechanisms (i.e., crankarm and crankset) to be used with a conventional clipless pedal or a regular bicycle pedal and toe clip.

Figure 2:
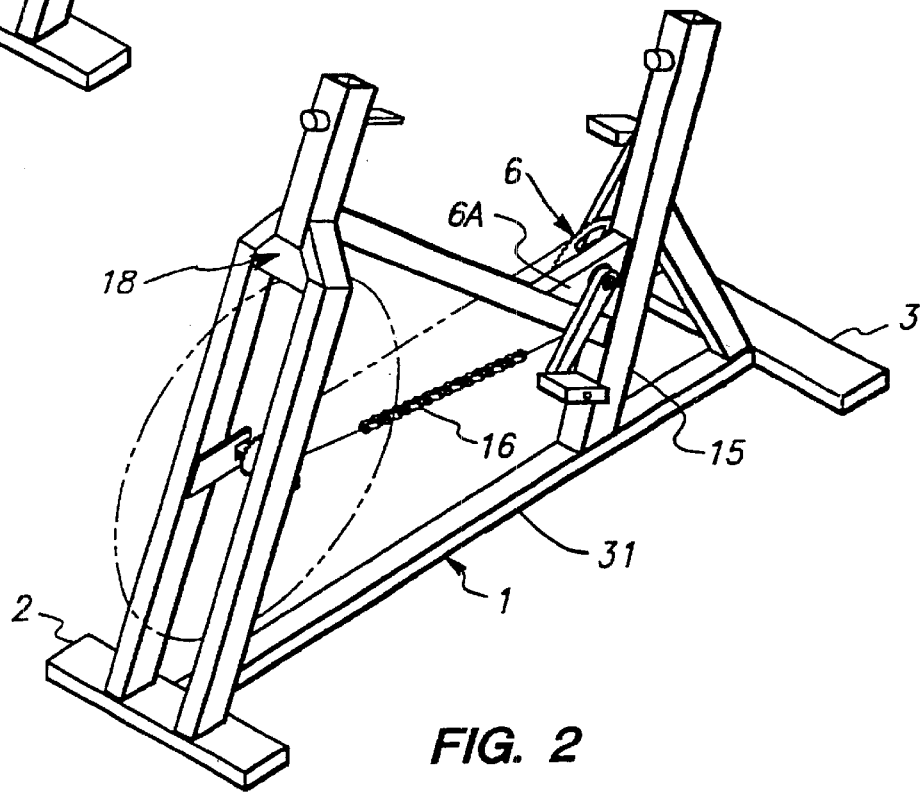
FIG. 2 is an isometric view of the pedal mechanism and a flywheel, both shown in phantom, including the ring guard, cog, and endless chain.

The front triangle-like structure 7 is wide enough to house a flywheel (FIG. 2). The front triangle-like structure 7 gives the stationary exercise bicycle its total range of motion moving the flywheel in and out and giving the stationary exercise bicycle its base length or reel length from foot position to foot position.

The flywheel is connected to the frame 1 or 24 by the front fork triangle 18.

Further, at least part of the front socket 4, rear socket 5, or seat socket 12 are formed with a hollow member having a cross section being non-cylindrical. The sockets described herein permit a matingly shaped connecting member (such as the handlebar 8, the adjustable and detachable seat 20), the connecting member being arrestable by a pop pin 19, 21, or 22.

The hollow member may have a polygonal cross section (preferably quadratic). For example, in the illustrated example, the polygonal cross section is substantially square.

The seat is adjustable for height and connected to the seat socket 12. The seat post pop pin 19 permits height adjustment of the seat. The fore and aft saddle pop pin 21 permits adjustment of the seat 20 by sliding fore and aft in the seat socket 12.

Because of the adjustability of the seat and the handlebar, a rider theoretically may be as tall as 15 feet and weigh up to 900 pounds. The handlebar and seat adjustability provides for a versatile bicycle which can be used by persons of many different physiques, from small, light and short to large, tall and heavy.

Figure 3:
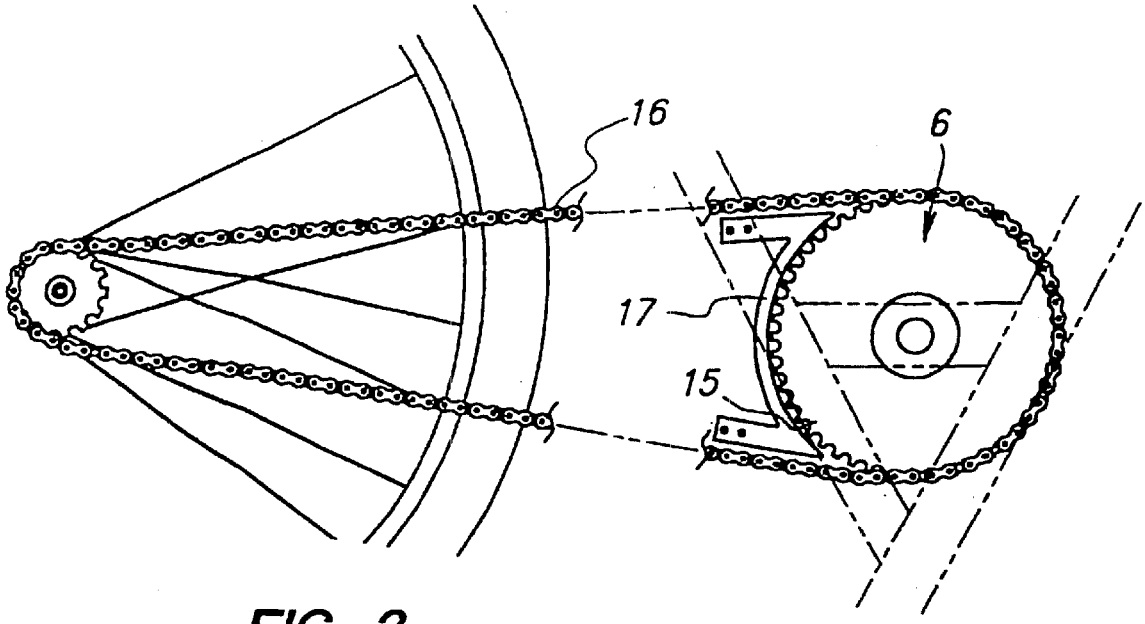
FIG. 3 is a detailed view of the ring guard in relation to the cog and frame.
Figure 4:
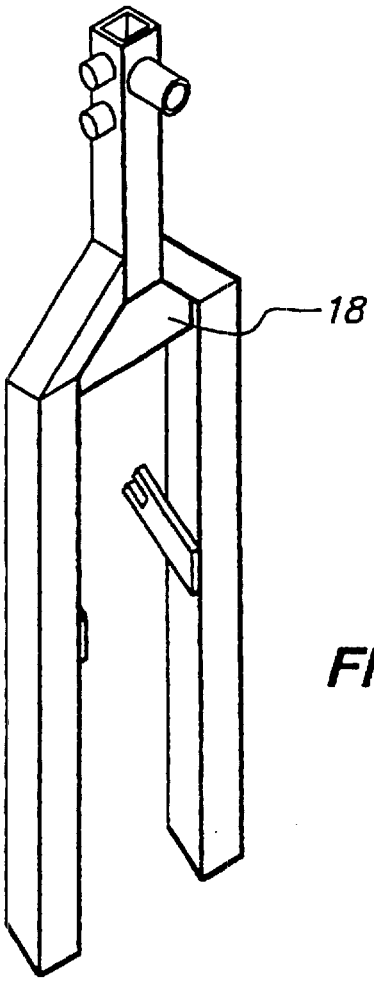
FIG. 4 is an isometric view of the front fork triangle and an upstanding post.
Figure 5:
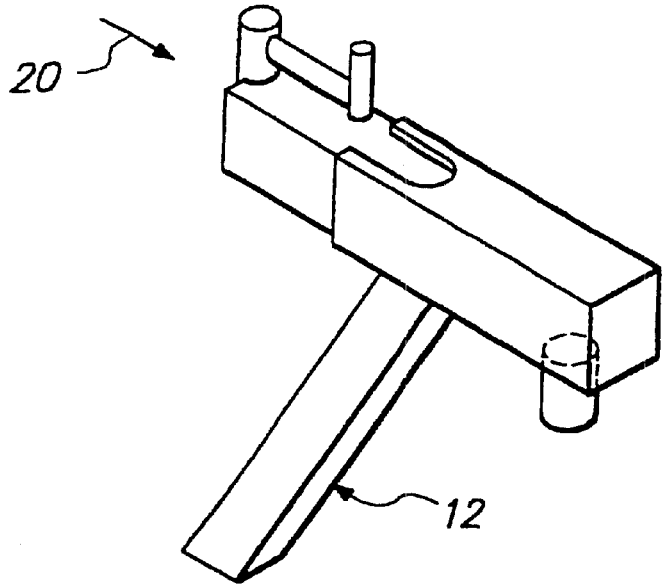
FIG. 5 is an isometric view of the seat socket and the connective member.

Referring now to FIG. 3, the pedal mechanism 6 includes a cog 15 operative with an endless chain 16 having slots for engagement with the cog 15. Additionally, the pedal mechanism 6 includes a ring guard 17 protective of at least the interaction of the teeth of the cog 15 with the endless chain 16. The ring guard 17 is located internally of the perimeter defined by the endless chain 16.

It would be desirable to provide attachments to the present invention. For example, a water bottle may be attached directly to the present invention or indirectly by means of a velcro device or any carrier means for attaching the water bottle to the stationary exercise bicycle.

Additionally, an ergometer may be attached to the present invention. Also, a computer controlled energy measuring and indicating device may be attached to the present invention.

The stationary exercise bicycle may comprise a dual chain tension device which is adjustable while the rider is in motion. Moreover, the stationary exercise bicycle may comprise a cable resistance braking system which permits the rider to adjust the resistance of the flywheel. A resistance plate 23 may support a cable to the flywheel.

The length and width of the stationary exercise bicycle is appropriate for standing and sitting while pedaling. Additionally, the width is appropriate for pedaling while sitting and for stabilization when the rider pedals while standing and rocking the body from side to side.

In a preferred form, the triangulated structures 14A, 14B, 7 stabilize the stationary exercise bicycle. These triangulated structures form the "integrity" structure of the stationary exercise bicycle.

The symmetry of this machine is very basic. The genius in the present invention is in its simplicity. The present invention simulates road conditions exactly as if the rider is pedaling a conventional, non-stationary bicycle.

Applicant contemplates many other examples of the present invention each differing by detail only. For example, there are many variations of the sockets described herein. The sockets described herein may not only permit a matingly shaped connecting member to fit inside (such as the handlebar 8, the adjustable and detachable seat 20), the connecting member being arrestable by a pop pin 19, 21, or 22. In fact, the matingly shaped connecting member may be a hollow into which the socket fits, e.g., the rear, front, or seat socket.

Additionally, the handlebar 8 may include at least two different handle means. One handle means includes spaced apart and outwardly directed elements 9. The second handle means may include an element (e.g., a closed ring) outwardly located relative to the first handle means.

Further, in one form, the frame may have a plurality of segments. Instead of a single unit, the frame may collapse into several units which permits even greater mobility of the stationary exercise bicycle for transport. Each unit of the frame may be re-assembled using bolts or any other type of well known connecting means.

The above description and drawings are only illustrative. They are not intended to limit in any way the invention as set out in the claims which follow.

What is claimed is:

1. A stationary exercise bicycle that is adjustable to allow a rider to adopt different riding positions, comprising:

a frame having front and rear sockets;

an adjustable seat mounted in the rear socket, the adjustable seat being extendable in fore and aft directions relative to the rear socket; and an adjustable handlebar mounted in the front socket, the handlebar including a lateral bar directed outwardly from the front socket, a first handle having at least one prong extending forwardly from said lateral bar, and at least one second handle inwardly located relative to the at least one prong.

2. The stationary exercise bicycle of claim 1 wherein the at least one second handle is a ring.

3. The stationary exercise bicycle of claim 2 wherein the ring is a semi-circle.

4. The stationary exercise bicycle of claim 1 wherein the first handle includes two prongs having free ends extending upwardly.

5. The stationary exercise bicycle of claim 1, further comprising a pedal mechanism mounted to the frame.

6. The stationary exercise bicycle of claim 5 wherein the pedal mechanism comprises a crank arm and a crankset.

7. The stationary exercise bicycle of claim 6, wherein the pedal mechanism is a conventional non-stationary bicycle pedal assembly.

8. The stationary exercise bicycle of claim 1 wherein the seat includes a means for detaching the seat from the rear socket.

9. The stationary exercise bicycle of claim 1 wherein the handlebar includes a means for detaching the handlebar from the front socket.

10. The stationary exercise bicycle of claim 1, further comprising a resistance system for simulating outdoor riding conditions.

11. The stationary exercise bicycle of claim 1 wherein the handlebar comprises a first gripping position, a second gripping position different from the first, and a third gripping position different from the first and the second gripping positions for use by the rider to simulate outdoor riding conditions.

12. The stationary exercise bicycle of claim 5 wherein the pedal mechanism is a clipless pedal.

13. The stationary exercise bicycle of claim 1 wherein the handlebar is adjustable relative to the adjustable seat.

14. A stationary exercise bicycle that is adjustable to allow a rider to adopt different riding positions, including alternating sitting and standing positions, while remaining on the bicycle, comprising:

a frame having front and rear sockets;

a seat adjustably mounted in the rear socket, the adjustable seat being extendable in fore and aft directions relative to the rear socket, and being adjustable to a seat position that allows the rider to adopt different riding positions, including alternating sitting and standing positions, while remaining on the bicycle; and a handlebar adjustably mounted in the front socket, the handlebar including a lateral bar directed outwardly from the front socket, a first handle having prongs extending forwardly from soid lateral bar, and a second handle inwardly located relative to the prongs, the handlebar being adjustable to a handlebar position that allows the rider to adopt different riding positions, including alternating sitting and standing positions, while remaining on the bicycle.

15. A stationary exercise bicycle that is adjustable to allow a rider to adopt different riding positions, comprising:

a front socket;

a rear socket;

a singular diagonal frame element that is connected to the front socket and the rear socket, that extends diagonally and linearly downward from the front socket to the rear socket, and that includes a mount for a pedal assembly;

a seat adjustably mounted in the rear socket, the seat being extendable in fore and aft directions relative to the rear socket; and a handlebar adjustably mounted in the front socket wherein the handlebar further comprises an upright portion, a lateral bar directed outwardly from the upright portion, a first handle having at least one prong extending forwardly from said lateral bar, and at least one second handle extending forwardly from said lateral bar.

16. The stationary exercise bicycle of claim 15, wherein the singular diagonal frame element extends beyond the rear socket, the bicycle further comprising:

a front ground support connected to the front socket; and a rear ground support connected to the singular diagonal frame element.

17. The stationary exercise bicycle of claim 16, further comprising a central ground support connected to and extending between the front ground support and the rear ground support.

18. The stationary exercise bicycle of claim 15, wherein the singular diagonal frame element terminates at the rear socket, the bicycle further comprising:

a front ground support connected to the front socket;

a central ground support connected to the front ground support and the rear socket, and extending rearward of the rear socket;

a second frame element that is connected to the rear socket and the central ground support, and that extends downward from the rear socket to the central ground support; and a rear ground support connected to the central ground support.

19. A stationary exercise bicycle that is adjustable to allow a rider to adopt different riding positions, the stationary exercise bicycle comprising:

a frame having front and rear sockets;

an adjustable seat mounted in the rear socket, the adjustable seat being extendable in fore and aft directions relative to the rear socket; and a handlebar mounted in the front socket, the handlebar comprising a lateral bar directed outwardly from the front socket and prongs connected to the lateral bar and having forwardly extending free ends, the free ends extending upwardly to form handle portions, and at least one second bar extending forwardly in a common plane relative to said lateral bar.

* * * * *

US006468185C1

(12) EX PARTE REEXAMINATION CERTIFICATE (8258th)

United States Patent

Goldberg

(10) Number: US 6,468,185 C1

(45) Certificate Issued: May 24, 2011

(54) STATIONARY EXERCISE BICYCLE

(75) Inventor: Johnny Goldberg, Los Angeles, CA (US)

(73) Assignee: Mad Dogg Athletics, Inc., Venice, CA (US)

Reexamination Request:
No. 90/010,829, Jan. 15, 2010

Reexamination Certificate for:

| | |
|---|---|
| Patent No.: | **6,468,185** |
| Issued: | **Oct. 22, 2002** |
| Appl. No.: | **09/672,197** |
| Filed: | **Sep. 28, 2000** |

Related U.S. Application Data

(63) Continuation of application No. 09/019,352, filed on Feb. 5, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.
*A63B 21/00* (2006.01)

(52) U.S. Cl. ..... 482/57; D21/663

(58) Field of Classification Search ..... 482/57
See application file for complete search history.

(56) References Cited

U.S. PATENT DOCUMENTS

| | | | |
|---|---|---|---|
| 4,296,940 | A | 10/1981 | Herbert |
| 4,477,072 | A | 10/1984 | DeCloux |
| D291,462 | S | 8/1987 | Aalto |
| D292,304 | S | 10/1987 | Ostrom |
| D299,732 | S | 2/1989 | Gustafsson |
| 4,938,475 | A | 7/1990 | Sargeant et al. |
| 5,154,095 | A | 10/1992 | Giard, Jr. |
| 5,199,324 | A | 4/1993 | Sain |
| 5,722,916 | A | 3/1998 | Goldberg |
| 6,155,958 | A | 12/2000 | Goldberg |
| 6,468,185 | B1 | 10/2002 | Goldberg |
| 6,881,178 | B1 | 4/2005 | Goldberg |
| 7,455,627 | B2 | 11/2008 | Goldberg |

FOREIGN PATENT DOCUMENTS

| | | |
|---|---|---|
| AU | B-22925/83 | 6/1984 |
| FR | 779363 | 12/1933 |

OTHER PUBLICATIONS

Pan's World International, Ltd., Fitness Range from Pan's World, Taipei, Taiwan, R.O.C., 1984, 12 pages.
Bicycling magazine cover, Nov. 1989, 1 page.

*Primary Examiner*—William C. Doerrler

(57) ABSTRACT

A stationary exercise bicycle comprises a frame having front and rear ground support elements, a front socket and a rear socket, and a seat socket; a pedal mechanism on said frame and a seat mounted on a seat socket at a level above the pedal mechanism, the seat being mounted for movement fore and aft relative to the seat socket, and upwardly and downwardly relative to the pedal mechanism.

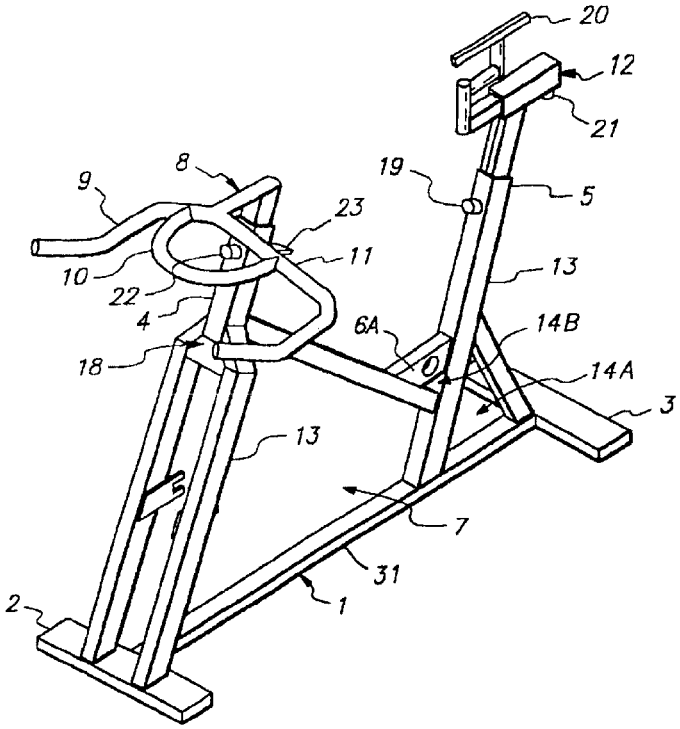

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 14, 15 and 19 are determined to be patentable as amended.

Claims 2-13 and 16-18, dependent on an amended claim, are determined to be patentable.

1. A stationary exercise bicycle that is adjustable to allow a rider to adopt different riding positions, comprising:

a frame having front and rear sockets;

an adjustable seat mounted in the rear socket, the adjustable seat being extendable in fore and aft directions relative to the rear socket; [and]

an adjustable handlebar *including a stem portion that is adjustably* mounted in the front socket, [the handlebar including] *a forward portion that is fixed to the stem portion, and a handle portion that is coupled to the forward portion in a manner that does not allow rotational adjustability of the handle portion when the stationary exercise bicycle is being ridden or not ridden and that includes* a lateral bar directed outwardly from the front socket, a first handle having at least one prong extending forwardly from said lateral bar, and at least one second handle inwardly located relative to the at least one prong *fixed to the handle porton*.

14. A stationary exercise bicycle that is adjustable to allow a rider to adopt different riding positions, including alternating sitting and standing positions, while remaining on the bicycle, comprising:

a frame having front and rear sockets;

a seat adjustably mounted in the rear socket, the adjustable seat being extendable in fore and aft directions relative to the rear socket, and being adjustable to a seat position that allows the rider to adopt different riding positions, including alternating sitting and standing positions, while remaining on the bicycle; and

*an adjustable* handlebar [adjustable] *including a stem portion that is adjustably* mounted in the front socket, [the handlebar including] *a forward portion that is fixed to the stem portion, and a handle portion that is coupled to the forward portion in a manner that does not allow rotational adjustability of the handle portion when the stationary exercise bicycle is being ridden or not ridden and that includes* a lateral bar directed outwardly from the front socket, a first handle having prongs extending forwardly from the [soid] lateral bar, and a second handle inwardly located relative to the prongs *and fixed to the handle* portion, the handlebar being adjustable to a handlebar position that allows the rider to adopt different riding positions, including alternating sitting and standing positions, while remaining on the bicycle.

15. A stationary exercise bicycle that is adjustable to allow a rider to adopt different riding positions, comprising:

a front socket;

a rear socket;

a singular diagonal frame element that is connected to the front socket and the rear socket, that extends diagonally and linearly downward from the front socket to the rear socket, and that includes a mount for a pedal assembly;

a seat adjustably mounted in the rear socket, the seat being extendable in fore and aft directions relative to the rear socket; and a handlebar adjustably mounted in the front socket wherein the handlebar further comprises an upright portion[.] *that is adjustable in the front socket, a forward portion that is fixed to the upright portion, and a handle portion that is coupled to the forward portion in a manner that does not allow rotational adjustability of the handle portion when the stationary exercise bicycle is being ridden or not ridden and that includes* a lateral bar directed outwardly from the upright portion, a first handle having at least one prong extending forwardly from said lateral bar, and at least one second handle extending forwardly from said lateral bar *and fixed to said lateral bar*.

19. A stationary exercise bicycle that is adjustable to allow a rider to adopt different riding positions, the stationary exercise bicycle comprising:

a frame having front and rear sockets;

an adjustable seat mounted in the rear socket, the adjustable seat being extendable in fore and aft directions relative to the rear socket; and a handlebar *including a stem portion that is adjustably* mounted in the front socket, the handlebar *further* comprising a *forward portion that is fixed to the stem portion, and a handle portion that is coupled to the forward portion in a manner that does not allow rotational adjustability of the handle portion when the stationary bicycle is being ridden or not ridden and that includes a* lateral bar directed outwardly from the front socket and prongs connected to the lateral bar and having forwardly extending free ends, the free ends extending upwardly to form handle portions, and at least one second bar *fixed to the handle portion and* extending forwardly in a common plane relative to said lateral bar.

* * * * *

US006468185C2

(12) EX PARTE REEXAMINATION CERTIFICATE (9627th)

United States Patent

Goldberg

(10) Number: US 6,468,185 C2

(45) **Certificate Issued: *May 2, 2013**

(54) STATIONARY EXERCISE BICYCLE

(75) Inventor: Johnny Goldberg, Los Angeles, CA (US)

(73) Assignee: Mad Dogg Athletics, Inc., Venice, CA (US)

Reexamination Request:
No. 90/012,193, Mar. 14, 2012

Reexamination Certificate for:

| | |
|---|---|
| Patent No.: | **6,468,185** |
| Issued: | **Oct. 22, 2002** |
| Appl. No.: | **09/672,197** |
| Filed: | **Sep. 28, 2000** |

Reexamination Certificate C1 6,468,185 issued May 24, 2011

( * ) Notice: This patent is subject to a terminal disclaimer.

Related U.S. Application Data

(63) Continuation of application No. 09/019,352, filed on Feb. 5, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.
*A63B 21/00* (2006.01)

(52) U.S. Cl.
USPC ..... 482/57; D21/663

(58) Field of Classification Search
None
See application file for complete search history.

(56) References Cited

To view the complete listing of prior art documents cited during the proceeding for Reexamination Control Number 90/012,193, please refer to the USPTO's public Patent Application Information Retrieval (PAIR) system under the Display References tab.

*Primary Examiner* — Danton Demille

(57) ABSTRACT

A stationary exercise bicycle comprises a frame having front and rear ground support elements, a front socket and a rear socket, and a seat socket; a pedal mechanism on said frame and a seat mounted on a seat socket at a level above the pedal mechanism, the seat being mounted for movement fore and aft relative to the seat socket, and upwardly and downwardly relative to the pedal mechanism.

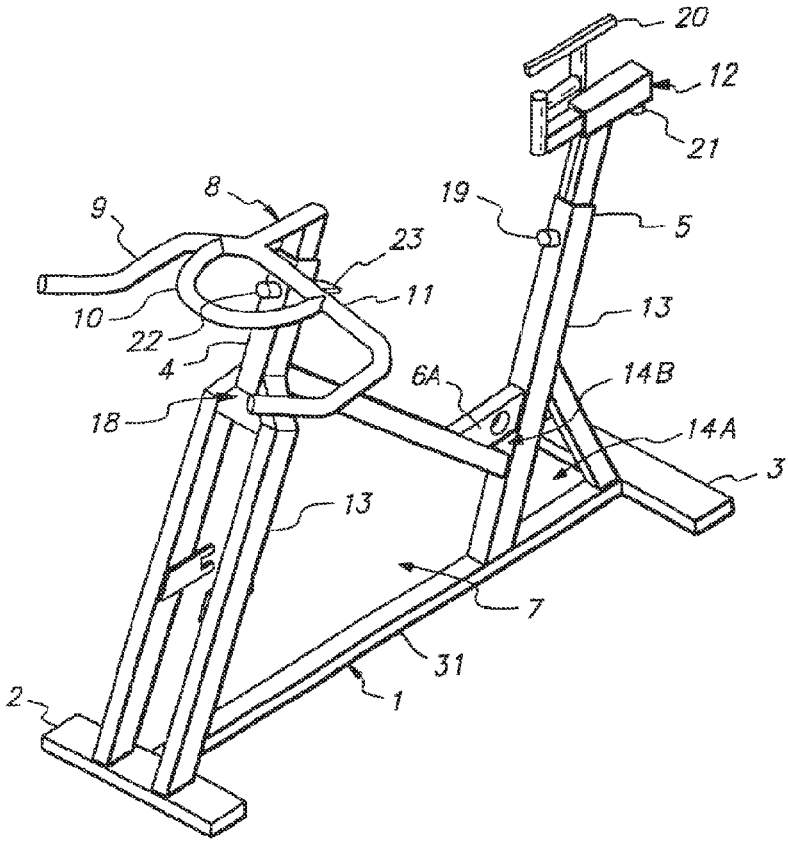

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-19 is confirmed.

* * * * *